US009399275B2

(12) United States Patent
Esenwein et al.

(10) Patent No.: US 9,399,275 B2
(45) Date of Patent: Jul. 26, 2016

(54) MACHINE TOOL, IN PARTICULAR HAND MACHINE TOOL

(75) Inventors: Florian Esenwein, Uhingen-Holzhausen (DE); Manfred Lutz, Filderstadt (DE); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 971 days.

(21) Appl. No.: 13/322,538

(22) PCT Filed: Apr. 16, 2010

(86) PCT No.: PCT/EP2010/055027

§ 371 (c)(1), (2), (4) Date: Feb. 9, 2012

(87) PCT Pub. No.: WO2010/136261

PCT Pub. Date: Dec. 2, 2010

(65) Prior Publication Data

US 2012/0138325 A1 Jun. 7, 2012

(30) Foreign Application Priority Data

May 27, 2009 (DE) ..... 10 2009 026 519

(51) Int. Cl.

| | |
|---|---|
| ***B23B 45/04*** | (2006.01) |
| ***B24B 23/00*** | (2006.01) |
| ***B25F 5/00*** | (2006.01) |
| ***B25F 5/02*** | (2006.01) |

(52) U.S. Cl.

CPC ..... *B24B 23/00* (2013.01); *B25F 5/008* (2013.01); *B25F 5/02* (2013.01)

(58) Field of Classification Search

CPC ..... B25F 5/00; B25F 5/02; B25F 5/008; B24B 23/00

USPC ..... 173/168, 217, 171, 216; 310/50, 60 R, 310/62; 451/488

See application file for complete search history.

(56) References Cited

U.S. PATENT DOCUMENTS

| | | | | |
|---|---|---|---|---|
| 6,043,575 | A * | 3/2000 | Ghode et al. | 310/52 |
| 2005/0098334 | A1* | 5/2005 | Lee | 173/104 |
| 2005/0225183 | A1* | 10/2005 | Braun et al. | 310/50 |
| 2006/0196684 | A1* | 9/2006 | Lee | 173/93.5 |

(Continued)

FOREIGN PATENT DOCUMENTS

| | | | |
|---|---|---|---|
| CN | 1402887 | A | 3/2003 |
| CN | 1701881 | A | 11/2005 |

(Continued)

OTHER PUBLICATIONS

International Search Report corresponding to PCT Application No. PCT/EP2010/055027, mailed Aug. 4, 2010 (German and English language document) (7 pages).

*Primary Examiner* — Thanh Truong
*Assistant Examiner* — Dianne Mitchell
(74) *Attorney, Agent, or Firm* — Maginot, Moore & Beck LLP

(57) ABSTRACT

A tool machine has a housing assembled by two separate housing parts and an air directing element arranged in the housing, wherein the air directing element is implemented independently from a connection device for connecting the housing parts. The air directing element is forced by a housing part axially in a seat in the other housing part, wherein in the transmission path between the housing parts and the air directing element a spring element is arranged.

15 Claims, 3 Drawing Sheets

(56) References Cited

U.S. PATENT DOCUMENTS

| | | | | |
|---|---|---|---|---|
| 2007/0295522 | A1* | 12/2007 | Bohne et al. | 173/162.2 |
| 2008/0099224 | A1* | 5/2008 | Hofmann et al. | 173/217 |
| 2008/0282850 | A1* | 11/2008 | Luebkert et al. | 81/177.1 |
| 2009/0280732 | A1* | 11/2009 | Esenwein | 451/359 |
| 2011/0036610 | A1* | 2/2011 | Vollmer et al. | 173/217 |

FOREIGN PATENT DOCUMENTS

| | | | | |
|---|---|---|---|---|
| DE | GB 998123 | A * | 7/1965 | |
| DE | 29 10 845 | | 10/1980 | |
| DE | 10 2007 017 243 | | 10/2008 | |
| EP | 1752260 | A1 | 2/2007 | |
| GB | 2 297 871 | | 8/1996 | |
| GB | 2297871 | A * | 8/1996 | H02K 5/20 |
| JP | 2004-338192 | A | 12/2004 | |
| JP | 2005-537947 | A | 12/2005 | |
| JP | 2006-6005 | A | 1/2006 | |
| JP | 2007-185717 | A | 7/2007 | |
| WO | WO 2007/081033 | A2 * | 7/2007 | |

* cited by examiner

MACHINE TOOL, IN PARTICULAR HAND MACHINE TOOL

This application is a 35 U.S.C. §371 National Stage Application of PCT/EP2010/055027, filed on Apr. 16, 2010, which claims the benefit of priority to Application Serial No. DE 10 2009 026 519.8, filed on May 27, 2009 in Germany, the disclosures of which are incorporated herein by reference in their entirety.

BACKGROUND

The disclosure relates to a machine tool, in particular a hand machine tool, with a housing including two separate housing parts.

DE 10 2007 017 243 A1 describes a hand machine tool having a two-part housing composed of a motor housing for receiving an electric drive motor and of a gear housing for receiving a gear, via which the movement of the armature shaft of the motor is converted into tool movement. To cool the motor, a fan wheel generates a cooling air stream which is led along the drive motor inside the housing and is conducted in the desired direction with the aid of an air guide ring. The air guide ring is arranged in the transitional region between the motor housing and gear housing and is firmly clamped between these housing parts.

In hand machine tools of this type, it is important to ensure exactly defined and permanent positioning of the drive motor and of the components belonging to the drive motor. Particularly in the longitudinal direction with respect to the motor or housing longitudinal axis, there is the risk, in the case of a plurality of housing construction parts or connecting devices arranged one behind the other, that there are deviations in nominal dimensions on account of tolerances, play and material aging, and this may lead to undesirable axial displacement between the brushes and the collector of the drive motor.

SUMMARY

The object on which the disclosure is based is, by simple structural measures, to design a machine tool, in particular a hand machine tool, which has an air guide ring in the housing, such that exact positioning of the housing parts of the housing with respect to one another or of construction parts in the housing is ensured over a long operating period.

This object is achieved, according to the disclosure, by means of the features set forth below. Expedient developments are also specified below.

The machine tool according to the disclosure, which is preferably a hand machine tool, in particular an electric hand tool, has a housing composed of at least two separate housing parts and also an air guide element which is arranged in the housing and which serves for guiding the flow of a cooling air stream conducted through the housing. The air guide element is preferably an air guide ring which is arranged between a fan wheel for generating the cooling air stream and the drive motor. However, the air guide element may also be formed by an air distributor which is arranged axially opposite to the air guide ring on the fan wheel.

In order to minimize the tolerance chain in the longitudinal direction with respect to the longitudinal axis of the motor or housing, there is provision for the air guide element to be formed independently of a connecting device which serves for connecting the housing parts. Furthermore, there is provision for the air guide element to be acted upon axially with force by one housing part into a seat in the other housing part, a spring element being arranged in the transmission path between the first housing part, the air guide element and the second housing part.

This version achieves various advantages. On the one hand, tolerances in the longitudinal direction are reduced, since, in contrast to versions from the prior art, the air guide element is no longer part of the connection between the housing parts, so that construction part tolerances in the air guide element or heat-induced or aging-induced length changes have no effect upon the relative positioning between the housing parts, and therefore the construction parts arranged in the housing parts can also maintain their position for a long operating period independently of the air guide element. Especially in the case of an electric drive motor which is arranged in a housing part designed as a motor housing, the motor spindle, the spindle bearings and the collectors can be held in the housing with higher positioning accuracy. Tolerances or a length change in the air guide element therefore have an effect only on the relative position of the latter in the housing, but not on the position of the drive motor.

In order at the same time to achieve secure fixing of the air guide element by simple measures, there is provision for the air guide element to be directly or indirectly acted upon axially with force by one of the housing parts into a seat in the other housing part. However, this action of force takes place independently of the fastening of the two housing parts one to the other. Moreover, the force of a spring element, which is arranged in the transmission path between the first housing part, the air guide element and the second housing part, acts upon the air guide element. The spring element, on the one hand, has the task of ensuring a play-free seat of the air guide element, in that the air guide element is pressed by one of the housing parts against the seat in the other housing part counter to the force of the spring element. On the other hand, however, the spring element also serves for decoupling the connection between the housing parts from the action of force of the one housing part upon the air guide element. The spring element ensures that basically lower forces act in this transmission chain than in the direct connection between the housing parts.

According to an advantageous version, the spring element is formed in one part with the air guide element. The air guide element is preferably composed of plastic, basically versions made from metal also being possible. In both variants, the spring element may be designed as a resilient supporting element on the air guide element, which, in the installation position, bears against an inner wall of the housing part from the seat for the air guide element.

Basically, however, versions of the spring element as a construction part formed separately from the air guide element may also be considered. For example, the spring element may be designed as a spiral or leaf spring which is arranged in the transmission chain between the housing parts and the air guide element. However, a version as a rubber element is possible and also, in general, as a damping element which, in addition to the damping properties, also has resilient properties. Basically, active compensating elements may also be considered, in which a manipulated variable acting upon the air guide element is generated as a function of input variables which are supplied.

The spring element acts, for example, in the radial direction, that is to say transversely to the longitudinal axis of the motor or housing. This version is advantageously combined with the resilient supporting element which is formed in one part with the air guide element and which lifts off axially from the basic body of the air guide element and can at least partially shift aside radially under the action of force. During such a radial movement of the supporting element, axial displacement of the air guide element is achieved at the same time. To assist the radial compensating movement, beveled contact faces on the supporting element and/or obliquely running inner walls in the seat of the housing part receiving the air guide element may be provided, so that, under the action of axial force, the supporting element shifts aside radially on account of the oblique faces, this being accompanied by axial displacement. The compensating movement of the spring element in the axial and/or radial direction is carried out until an equilibrium of forces in the spring element prevails, in which the action of force by one of the housing parts constitutes the critical force component.

However, additionally or alternatively to the radial type of action, the spring element may also act in the axial direction, for example in the version as a separate spring or as an actuator.

According to a further advantageous version, the air guide element forms an air guide ring which is arranged axially on one side of a fan wheel, an air distributor being positioned on the axially opposite side of the fan wheel. The air distributor can be used for acting with force upon the air guide ring, in which the air distributor is supported, on one axial end face, on the gear housing and acts on the opposite axial end face upon the air guide ring which is received in a seat in the motor housing.

Furthermore, it may be expedient to provide on the air guide element a supporting rib which supports the drive motor. However, the supporting rib advantageously serves only for fixing the drive motor in position in the event of heat-induced or aging-induced changes in position and does not serve for the permanent action of force. It may be expedient, in the regular installation position, to provide a narrow air gap between the supporting rib and drive motor.

BRIEF DESCRIPTION OF THE DRAWINGS

Further advantages and expedient versions may be gathered from the further claims, the figure description and the drawings in which:

DETAILED DESCRIPTION

Identical construction parts are given the same reference symbols in the figures.

Figure 1:
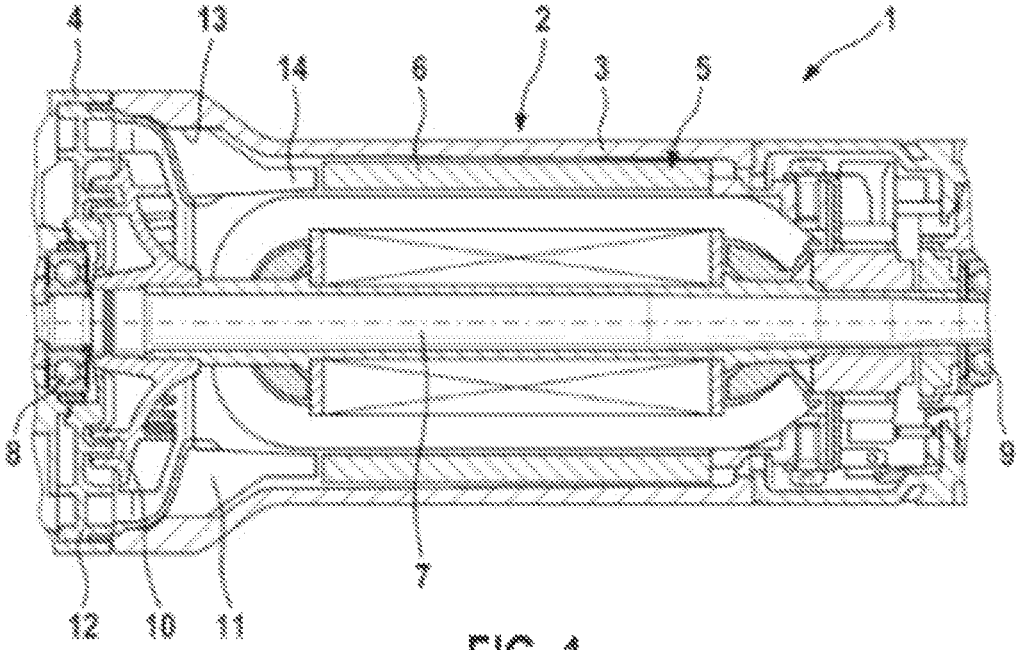
FIG. 1 shows a section through a hand machine tool in the region of a motor housing which receives an electric drive motor and which is connected on the end face to a gear housing, an air guide ring being arranged in the transitional region between the motor housing and gear housing.

FIG. 1 illustrates a detail from an electric hand machine tool 1 having a two-part housing 2 which is composed of a motor housing 3 and of a gear housing 4 formed separately from the latter, the motor housing 3 and gear housing 4 being arranged one behind the other in the direction of the longitudinal axis of an electric drive motor 5 and being connected to one another. The drive motor 5 is received in the motor housing 3 and has a stator 6 fixed to the housing and also an armature shaft 7 which rotates in the stator 6 and which is mounted rotatably in housing-side bearings 8 and 9.

Axially preceding the drive motor 5, in the transitional region between the motor housing 3 and gear housing 4, a fan wheel 10 is received inside the housing and generates a cooling air stream which is sucked into the interior of the housing and sweeps axially along the drive motor 5 for cooling purposes. For flow guidance, an air guide ring 11 is provided which precedes the fan wheel 10 axially and which is arranged axially between the fan wheel 10 and the drive motor 5. Furthermore, an air distributor 12 is located on the axially opposite end face of the fan wheel 10.

The air guide ring 11 is received in a seat 13 in the motor housing 3, the seat 13 lying adjacently to the free end face of the motor housing 3. Formed axially in one part with the basic body of the air guide ring 11 is a supporting rib 14 which extends axially in the direction of the drive motor 5 and the free end face of which lies with a slight clearance with respect to the stator 6 of the drive motor. The supporting rib 14 supports the stator 6 in the event of a displacement in the position of the drive motor 5 within the motor housing 3.

The air guide ring 11 is acted upon axially with force into its seat 13 in the motor housing 3 by the gear housing 4 or by a construction part arranged on the gear housing 4. Moreover, a spring element is located in the transmission path between the gear housing 4, the air guide ring 11 and the motor housing 3 and absorbs the axial force which emanates in the installation position from the gear housing 4.

The connection between the motor housing 3 and the gear housing 4 takes place independently of the air guide ring 11 and also independently of the further air-guiding elements, that is to say the fan wheel 10 and the air distributor 12. This ensures that the air-guiding elements do not have to transmit the connection force for connecting the two housing parts 3 and 4.

Figure 2:
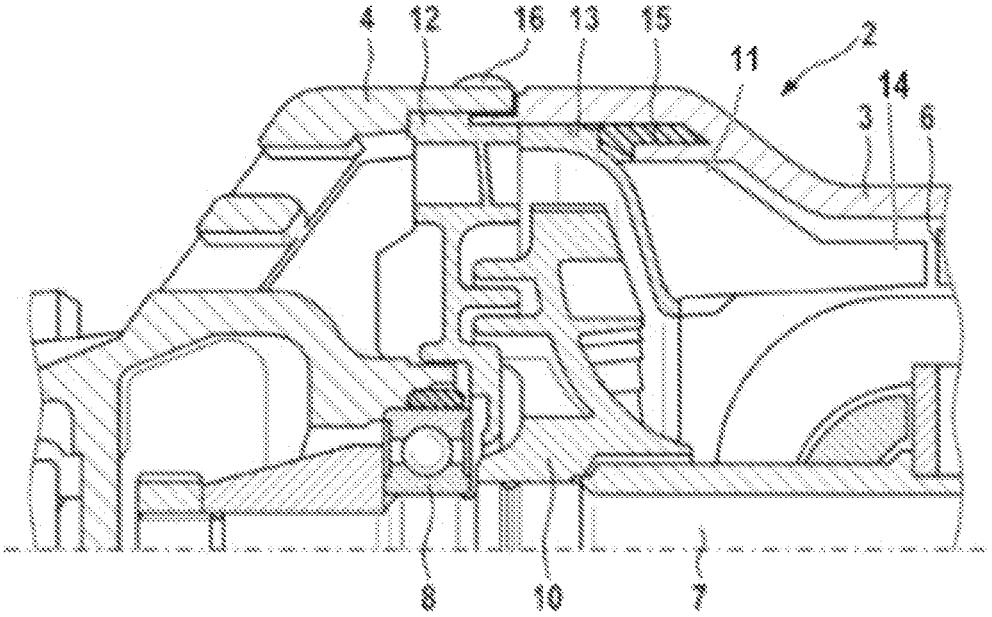
FIG. 2 shows an enlarged illustration of the housing of the hand machine tool from the region of transition between the motor housing and gear housing.

As may be gathered from the enlarged illustration according to FIG. 2, the air distributor 12 is supported axially on a shoulder on the gear housing 4. On the opposite end face, the air distributor 12 is in contact with the air guide ring 11 and exerts an axial force upon the latter. The air guide ring 11 received in the seat 13 in the motor housing 3 is supported, on the side lying opposite the air distributor 12, on a spring element 15 which is received in a pocket formed on the inner wall of the motor housing 3. The spring element 15 is formed, for example, as a rubber ring.

In the mounted position, the connection between the motor housing 3 and the gear housing 4 takes place with the aid of a connecting device 16 which is formed independently of the air guide ring 11. An axial force is exerted on the air guide ring 11 via the air distributor 12 and presses the air guide ring 11 against the spring element 15 in the motor housing 3, the spring element 15 building up an axial counterforce so that the air guide ring 11 is in an axial equilibrium of forces.

In the exemplary embodiments according to FIGS. 1 and 2, in the installation position the air guide ring 11 is arranged completely inside the motor housing 3. It is also basically possible, however, that the air guide ring 11 projects axially at least partially beyond the end face of the motor housing 3 and into the gear housing 4.

Figure 3:
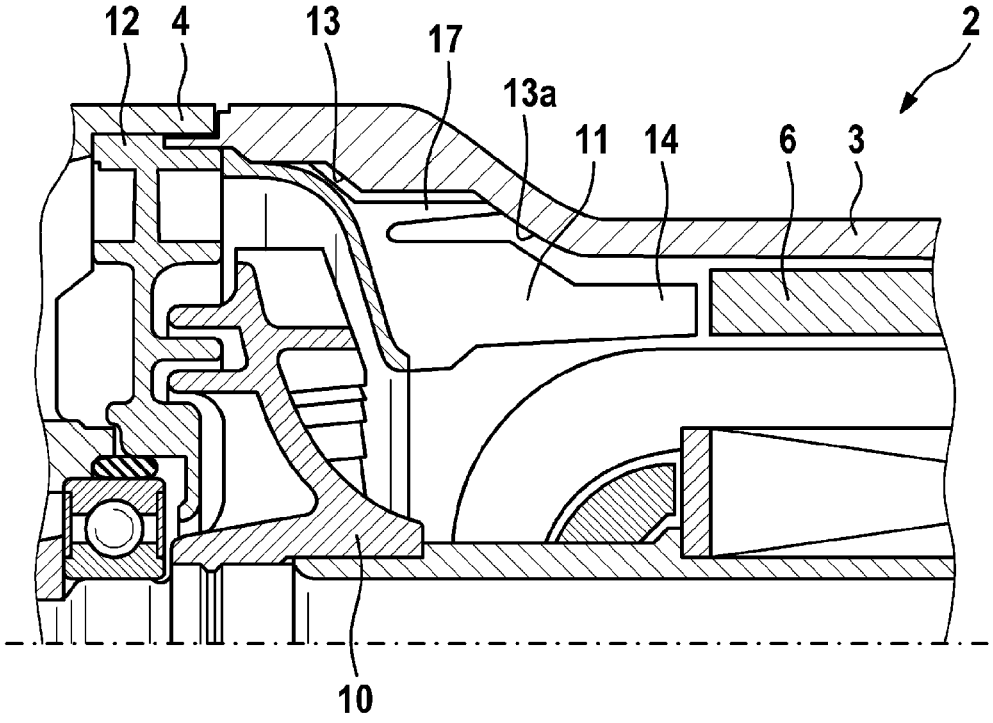
FIG. 3 shows a further housing illustration with an air guide ring in a further version.

In the exemplary embodiment according to FIG. 3, too, the air guide ring 11 is acted upon axially with force into its seat 13 in the motor housing 3 by the air distributor 12, the air distributor 12 being supported on the gear housing 4. A supporting element 17 is formed in one part with the air guide ring 11 and is designed as a supporting web which projects axially beyond the basic body of the air guide ring 11 and the free end face of which bears against an oblique inner wall 13*a* of the seat 13 in the motor housing 3. The supporting element 17 on the air guide ring 11 has radial spring movability and under the action of axial force is pressed against the oblique inner wall 13*a*, the supporting element 17 shifting radially inward on account of the slope of the inner wall 13*a*, whereupon the air guide ring is displaced axially into its seat 13 until an axial equilibrium of forces prevails.

Figure 4:
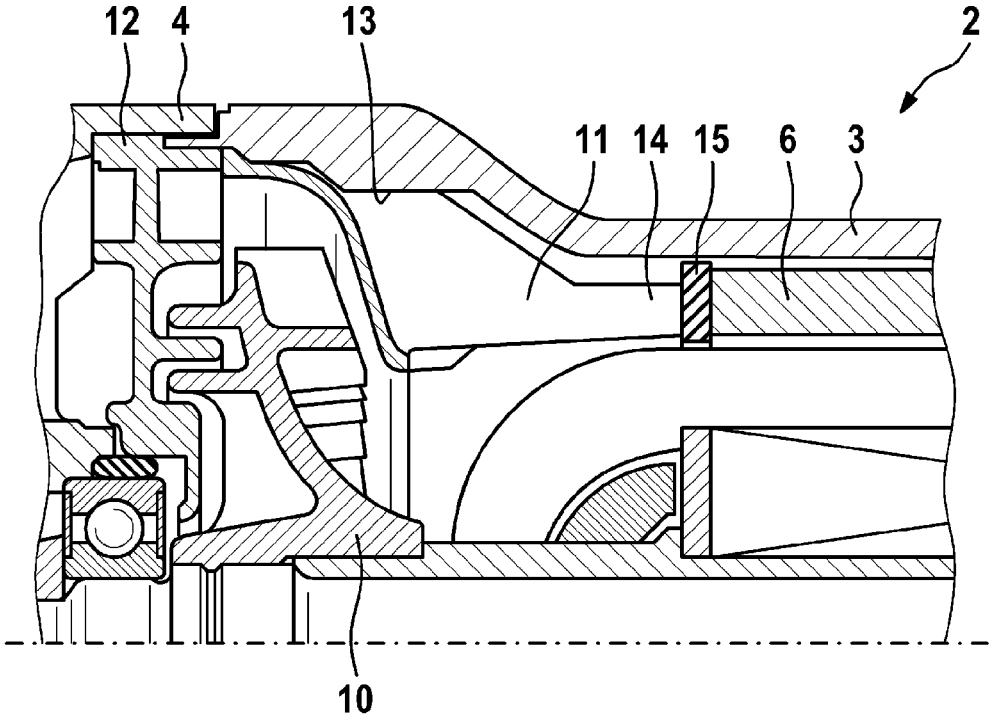
FIG. 4 shows yet a further illustration of a housing with an air guide ring in a further version.

In the exemplary embodiment according to FIG. 4, the air guide ring 11 is likewise acted upon axially with force into its seat 13 in the motor housing 3 by the air distributor 12 supported on the gear housing 4. As a spring element, a separate construction part 15 is provided, which is arranged between the axially projecting supporting rib 14 on the air guide ring 11 and the end face of the stator 6. The spring element 15 is designed as a rubber element or rubber buffer.

Figure 5:
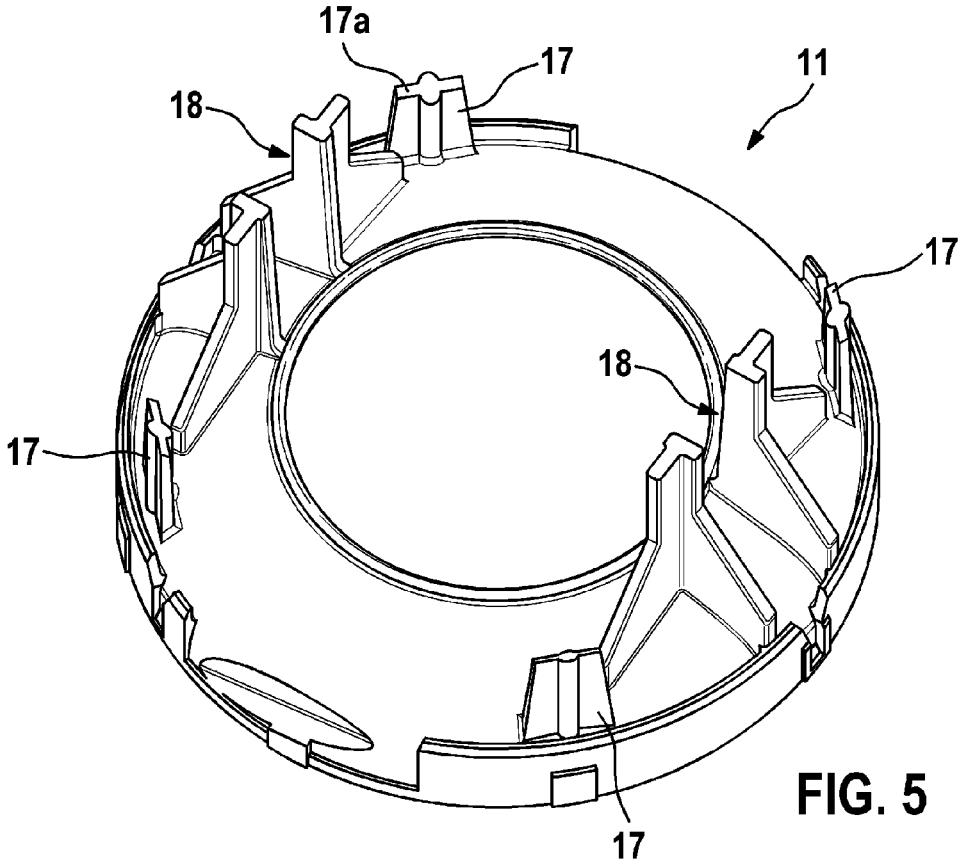
FIG. 5 shows an individual perspective illustration of an air guide ring.

FIG. 5 shows an individual illustration of an air guide ring 11 which corresponds to the air guide ring from the exemplary embodiment according to FIG. 3. Overall four supporting elements or legs 17 are arranged, distributed over the circumference of the air guide ring, which are located adjacently to the outer circumference of the basic body of the air guide ring and project axially above the basic body. The supporting elements 17 are formed in one part with the air guide ring and possess radial spring movability.

The free end face of the supporting elements 17 is designed as an oblique contact face 17*a* which is adapted (FIG. 3) to the slope of the inner wall 13*a* of the seat 13 in the motor housing 2. The radial shifting movement of the supporting elements 17 in the event of axial displacement into the seat 13 is consequently assisted.

Figure 6:
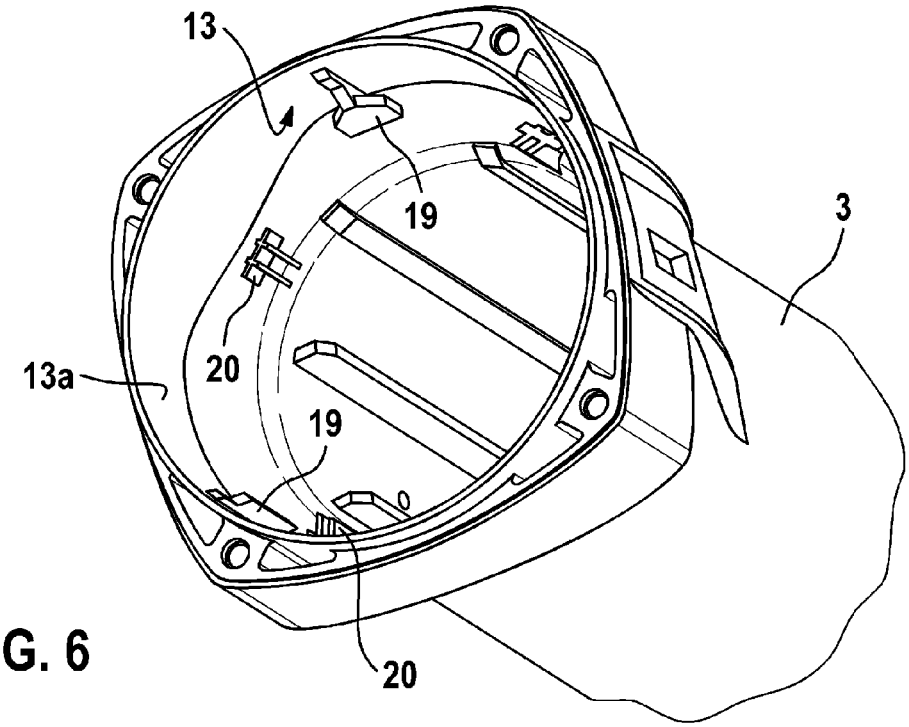
FIG. 6 shows an individual perspective illustration of a motor housing with a view of the end face.

Moreover, two form fit elements 18 are formed, diametrically opposite one another, in one part with the air guide ring 11 so as to be offset angularly with respect to the supporting elements 17. In the installed position, these form fit elements 18 are to be brought in the circumferential direction into a form fit with further form fit elements 19 which are arranged on the inner wall 13*a* in the seat 13 on the motor housing 3, as may be gathered from FIG. 6. Arrow impressions pointing toward the free end face may be arranged on the form fit elements 19 in the motor housing 3 in order to make it easier for the air guide ring to be introduced axially into the seat 13.

Guide parts 20, which are assigned in each case to a supporting element 17 on the air guide ring 11, are likewise located on the inner wall 13*a* of the motor housing 3. The number of guide parts 20 corresponds to the number of supporting elements 17. In the installation position, the supporting elements 17 lie between the inner wall 13*a* and the guide parts 20.

The invention claimed is:

1. A machine tool, comprising:

a housing including:

a first housing part; and a second housing part that is separate from the first housing part, that has an inner wall that, at least in part, is oblique with respect to a plane perpendicular to a longitudinal axis of the housing, and that includes a seat;

an air guide element positioned in the housing that is configured to guide a flow of an air stream through the housing, and that includes a supporting element that extends axially from the air guide element towards the second housing part, wherein the first housing part is configured to apply a force to press the air guide element into the seat of the second housing part:

the supporting element having an end face that is oblique with respect to the plane perpendicular to the longitudinal axis of the housing and that is substantially in opposition to the oblique part of the inner wall of the second housing part; and the end face being configured to bear against the oblique part of the inner wall;

a connecting device formed independently of the air guide element, and configured to connect the first and second housing parts; and a spring element that is positioned in a transmission path between the first housing part, the air guide element, and the second housing part.

2. The machine tool as claimed in claim 1, wherein the spring element is formed in one part with the air guide element.

3. The machine tool as claimed in claim 2, wherein the spring element is a resilient supporting element positioned on the air guide element.

4. The machine tool as claimed in claim 1, comprising a plurality of spring elements distributed over a circumference of the air guide element.

5. The machine tool as claimed in claim 1, wherein the spring element is supported on the inner wall of the second housing part.

6. The machine tool as claimed in claim 1, wherein the spring element is configured to be elastically resilient in a radial direction.

7. The machine tool as claimed in claim 1, wherein the first housing part is configured to hold the air guide element in a circumferential direction via a form fit.

8. The machine tool as claimed in claim 1, further comprising:

an air distributor supported by the second housing part, wherein:

the air guide element is an air guide ring; and the air distributor is configured to exert an axial force on the air guide ring.

9. The machine tool as claimed in claim 8, further comprising:

a fan wheel, wherein the air guide ring and the air distributor are positioned on axially opposite sides of the fan wheel.

10. The machine tool as claimed in claim 1, further comprising:

a drive motor disposed within the first housing part, wherein the air guide element further includes a supporting rib that extends axially toward the drive motor, the drive motor and the supporting rib separated by a clearance such that the supporting rib is configured to support the rib in response to a displacement of the drive motor within the first housing part.

11. The machine tool as claimed in claim 10, wherein the spring element is positioned between the air guide element and the drive motor.

12. The machine tool as claimed in claim 1, wherein the spring element is a rubber element.

13. The machine tool as claimed in claim 1, wherein the spring element is a spiral spring or a leaf spring.

14. The machine tool as claimed in claim 1, wherein the spring element is an active compensating element that is configured to act upon the air guide element.

15. A machine tool, comprising:

a housing including:

a first housing part; and a second housing part that is separate from the first housing part, that has an inner wall that, at least in part, is oblique with respect to a plane perpendicular to a longitudinal axis of the housing, and that includes a seat, an air guide element positioned in the housing that is configured to guide a flow of an air stream through the housing, and that includes a supporting element that extends axially from the air guide element towards the second housing part:

the supporting element having an end face that is oblique with respect to the plane perpendicular to the longitudinal axis of the housing and that is substantially in opposition to the oblique part of the inner wall of the second housing part; and the end face being configured to bear against the oblique part of the inner wall; and a connecting device formed independently of the air guide element, and configured to connect the first and second housing parts;

wherein the supporting element includes a spring element that is arranged in a transmission path between the first housing part, the air guide element, and the second housing part, and that is configured to act on the air guide element transversely with respect to the longitudinal axis, wherein the first housing part is configured to act on the air guide element axially with respect to the longitudinal axis and push the air guide element into the seat in the second housing part; and wherein the spring element, end face, and the oblique part of the inner wall are arranged such that a radial motion of the air guide element is at least partially transformed into an axial motion in order to compensate for the radial motion.

* * * * *